US007731172B2

(12) United States Patent
Yano

(10) Patent No.: US 7,731,172 B2
(45) Date of Patent: Jun. 8, 2010

(54) TRANSPORT DEVICE AND IMAGE-FORMATION DEVICE

(75) Inventor: Hidetoshi Yano, Tokai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1001 days.

(21) Appl. No.: 11/483,607

(22) Filed: Jul. 11, 2006

(65) Prior Publication Data

US 2007/0014598 A1 Jan. 18, 2007

(30) Foreign Application Priority Data

Jul. 12, 2005 (JP) ..... 2005-203042

(51) Int. Cl.
*B65H 5/00* (2006.01)

(52) U.S. Cl. ..... 271/10.09; 74/396

(58) Field of Classification Search ..... 271/10.01, 271/10.09, 10.11, 10.13; 74/392, 396, 397, 74/411

See application file for complete search history.

(56) References Cited

U.S. PATENT DOCUMENTS 4,475,618 A * 10/1984 Kennedy et al. ..... 180/237
4,960,006 A * 10/1990 Moore ..... 74/384
6,367,994 B2 4/2002 Oshima et al.
6,974,127 B2 * 12/2005 Kang ..... 271/10.11

FOREIGN PATENT DOCUMENTS

JP 6-227071 8/1994
JP 6-263273 9/1994

* cited by examiner

*Primary Examiner*—Patrick Mackey
*Assistant Examiner*—Michael C McCullough
(74) *Attorney, Agent, or Firm*—Banner & Witcoff, Ltd

(57) ABSTRACT

A system that prevents the engagement of an intermediate gear and a driven gear from releasing due to a force from the driven gear without increasing an arrangement angle is described. A surface receiving a load acting on a rotation axis of a second groove that is used as an axle bearing formed on the side of a second gear part that engages with a driven gear is made to be an inclined receiving part. The second receiving surface touches the rotation axis of the second groove part. The surfaces are arranged such that the distance from the center of rotation of the driving gear increases as it moves away from the driven gear. By this arrangement, the inclined receiving part creates a force in the opposite direction of the direction to release the intermediate gear from the driven gear that acts upon the rotation axis as the counteraction of the force that acts on the rotation axis, so the intermediate gear does not separate from the driven gear.

6 Claims, 12 Drawing Sheets

TRANSPORT DEVICE AND IMAGE-FORMATION DEVICE

RELATED APPLICATION INFORMATION

This application claims priority from Japanese Patent Application No. 2005-203042, filed Jul. 12, 2005, whose contents are expressly incorporated herein by reference.

BACKGROUND

A transport device (or paper feed device) of a printer transfers a transporting force to a recording medium such as paper, etc., by transmitting the driving force generated by a drive source such as a motor, etc., via multiple gears to transport rollers and rotating the transport rollers.

If for any reason the recording medium should become jammed while being transported, it is necessary to pause the transport rollers (the transport device) and remove the recording medium that has become jammed. In these situations, the recording medium is ordinarily pressed against the transport rollers. So, when the recording medium is pulled to remove the recording medium, the recording medium engages with the transport rollers and forces them to rotate as the recording medium is forcibly removed.

At this time, when the rotation of the transport rollers is transmitted via the gears to the motor (that is the drive source), the force required to rotate the transport rollers becomes extremely large, and a large force becomes necessary in order to remove the recording medium. So the workability of the operation to remove the recording medium that has become jammed deteriorates remarkably.

With this difficulty of conventional systems, an intermediate gear (a planetary gear) that engages with a driving gear (a sun gear) has been used so that it can rotate (and/or oscillate) in relation to the center of rotation of the driving gear. The driving force of the driving gear is transmitted via this intermediate gear to the driven gear in order to transport the recording medium. If for any reason the paper should become jammed, then the driving gear is rotated in reverse. The intermediate gear uses the reaction force received from the driving gear to rotate (and/or oscillate) the intermediate gear in relation to the center of rotation of the driving gear, such that the engaged state of the driven gear and the intermediate gear is released, preventing the rotation from being transmitted from the driven gear (driven by the force associated with the removal the recording medium) to the driving gear.

Incidentally, the intermediate gear receives a reaction force from the driven gear as well, and the direction of this reaction force—in an involute gear, for example—becomes the direction of the angle formed by a tangent line that passes through the pitch point where the pitch circle and the involute tooth intersect and a perpendicular line erected at the involute tooth that passes through this pitch point, or in other words, the direction of the pressure angle at the pitch point.

Also, the reaction force F from the driven gear 103 is ultimately received at the rotation axis 102*c* of the intermediate gear 102 as shown in FIG. 12. When the pressure angle is made to be 20°, a first center line L1 is made to connect the center of rotation O2 of the intermediate gear 102 and the center of rotation O1 of the driving gear 101, and a second center line L is made to connect the center of rotation O2 of the intermediate gear 102 and the center of rotation O3 of the driven gear 103. When the angle formed by the first center line L1 and the second center line L2 (hereinafter this angle is called the arrangement angle θ) is less than 110°, the force in the direction of releasing the engaged state of the driven gear 103 and the intermediate gear 102 acts on the rotation axis 102*c* (intermediate gear 102) due to the Fr component of reaction force F.

For this reason, when the arrangement angle θ is less than 110°, when the driving gear is rotated normally and the driving force is transmitted to the driven gear, the engagement of the intermediate gear and the driven gear is released, so it becomes impossible to transmit the driving force to the driven gear.

Correspondingly, it is acceptable to make the arrangement angle θ greater than or equal to 110°, but when the arrangement angle θ is increased, it is highly likely that a new problem will arise, namely that the driven gear or the driving gear will interfere with the other items.

Incidentally, if the arrangement angle θ is made to be 110° then the Fr component is no longer produced. Also, if the arrangement angle θ is made to be greater than or equal to 110°, then the direction of the Fr component becomes the opposite of that in FIG. 12, so the force in the direction of releasing the engaged state of the driven gear 103 and the intermediate gear 102 no longer acts on the rotation axis 102*c* (intermediate gear 102).

SUMMARY

Aspects of the invention are directed to address one or more issues associated with conventional systems. In an at least one aspect of the present invention, the release of the engagement of the intermediate gear and the driven year due to the reaction force from the driven gear without increasing the arrangement angle θ is prevented. Further aspects of the present invention relate to a transport device that transports a medium such as paper, etc., and that effective for image-formation devices such as laser printers and the like.

DETAILED DESCRIPTION

Aspects of the invention include the transport device and the image-formation device, where the image-forming device may or may not include a laser printer.

It is noted that various connections are set forth between elements in the following description. It is noted that these connections in general and, unless specified otherwise, may be direct or indirect and that this specification is not intended to be limiting in this respect.

1. Illustrative Laser Printer Configuration

Figure 1:
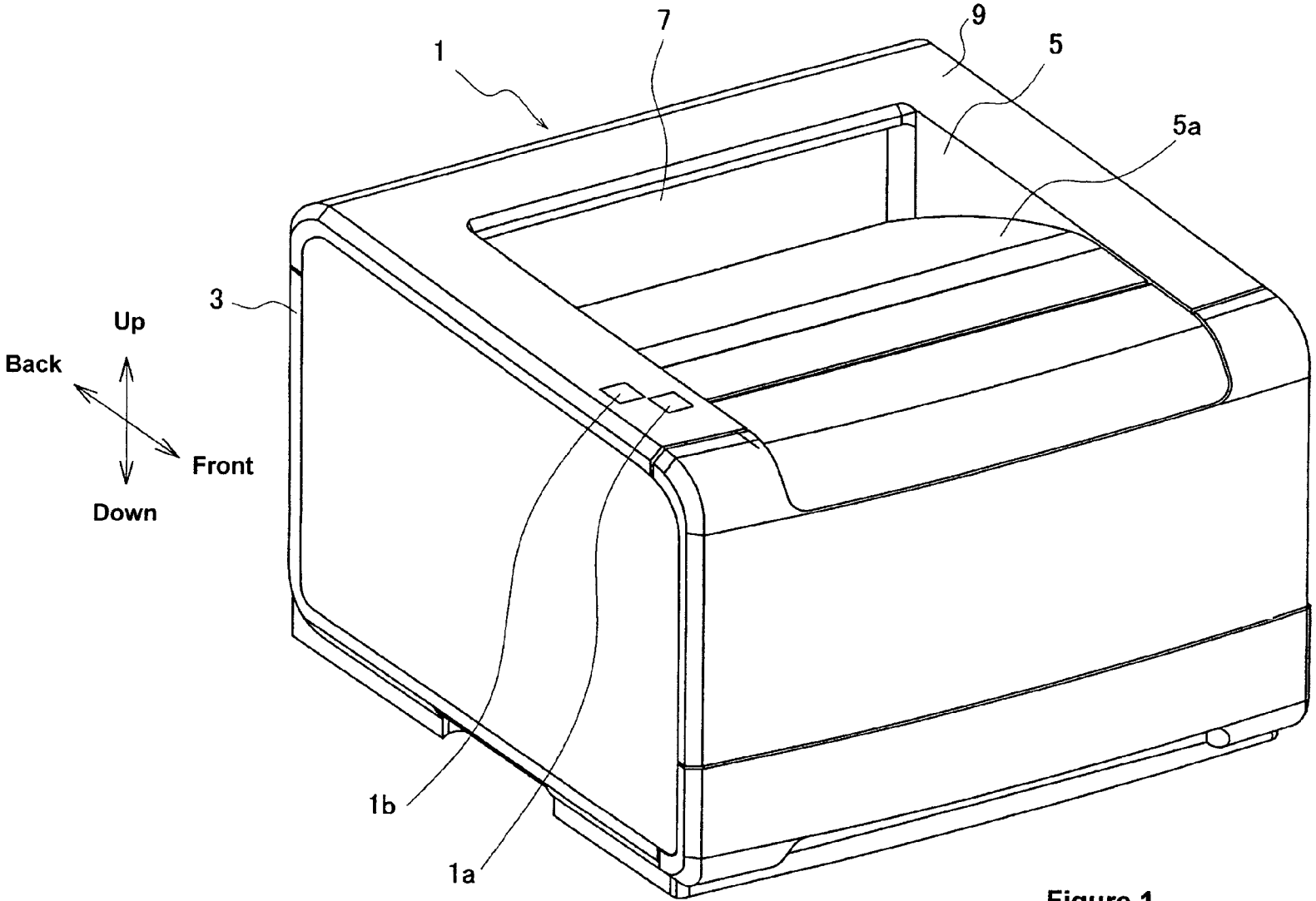
FIG. 1 shows a perspective view of the external appearance of a laser printer corresponding to illustrative embodiments of the present invention.

The following shows an illustrative configuration of a system that may use one or aspects of the present invention. FIG. 1 is a perspective view showing the external appearance of a laser printer 1. Here, the laser printer 1 has a top side of a paper surface as the upper side of the direction of gravity, and the paper is ordinarily used with the near side of the paper surface as the front side.

Next, the chassis 3 of the laser printer 1 is formed in an approximate box shape (a cube shape for instance), and a paper ejection tray 5—where the recording medium ejected from the chassis 3 when printing has been completed is held—is provided on the side of the upper surface of this chassis 3. Furthermore, in the present illustrative embodiment, the recording medium is assumed to be paper stock such as paper or overhead projector sheets, etc. It is appreciated that the chassis 3 and related parts may be of any shape or configuration.

In addition, the paper ejection tray 5 is configured with an inclined surface 5*a* that inclines downward from the top surface of the chassis 3 as it approaches the rear side, and an ejection part 7 (referring to FIG. 2) to which the recording medium is ejected when printing has been completed is provided at the rear side of this inclined surface 5*a*.

Next, an upper cover 9—which is formed in the approximate shape of a block C so that it surrounds the paper ejection tray 5 (inclined surface 5*a*) within the chassis 3—is provided with a line switch la that switches between a state where it connects the laser printer 1 to a network and the state where it disconnects it from the network, a job cancel switch 1*b* that forcibly ends (interrupts) printing, and so on.

2. Laser Printer Configuration

Figure 2:
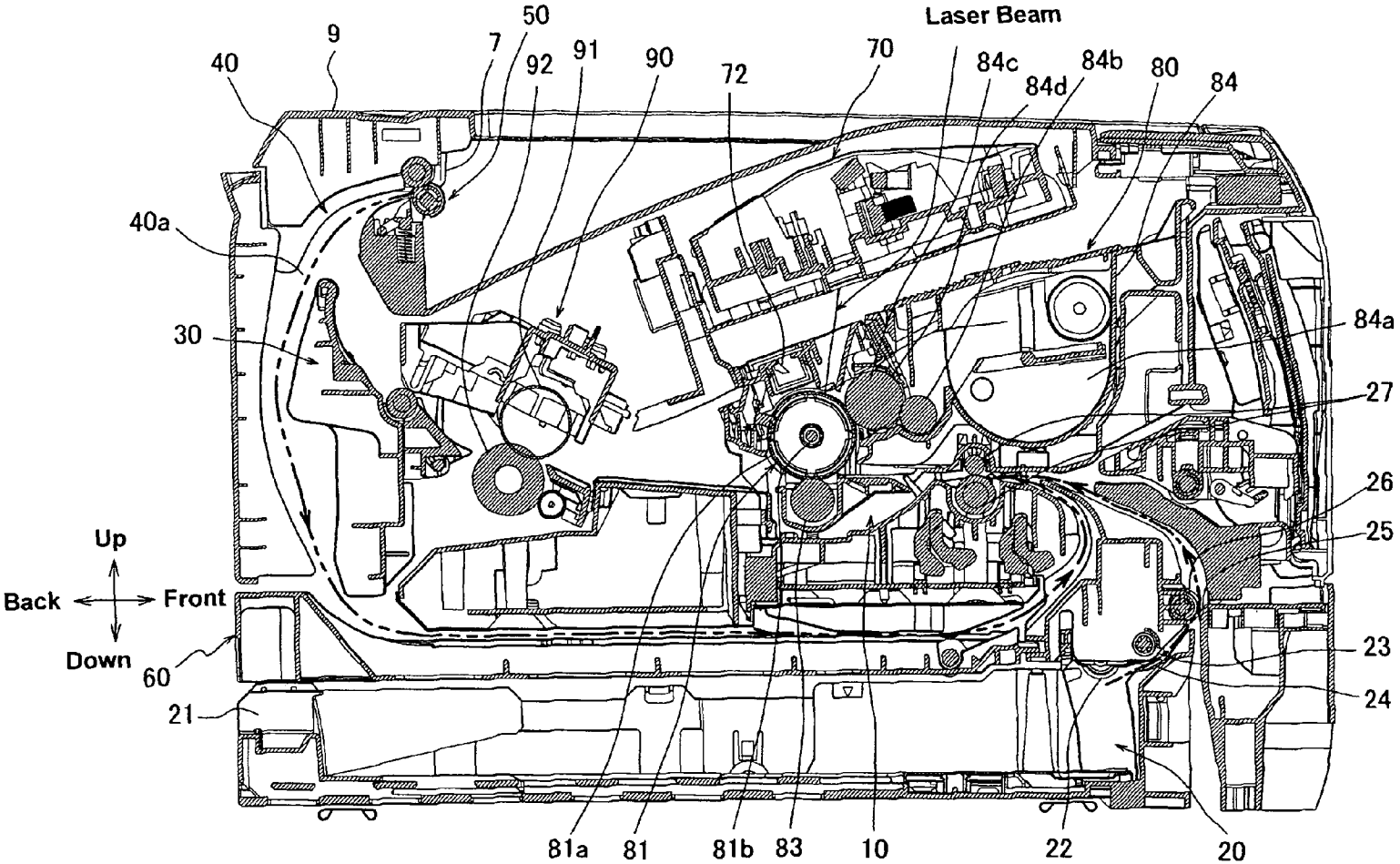
FIG. 2 shows a schematic sectional side view of various parts of a laser printer corresponding to illustrative embodiments of the present invention.

FIG. 2 is a schematic sectional side view showing the principal parts of the laser printer 1. Next, the image-formation part 10 constitutes an image-formation system that forms an image on a recording medium, and a feeder part 20 constitutes a part of the transport system that supplies the recording medium to the image-formation part 10.

The first ejection chute 30 and the second ejection chute 40 constitute a guide that rotates the transport path recording medium 180° when image-formation has been completed at the image-formation part 10 so that it makes a U-turn and guides the recording medium to the ejection part 7 provided on the upper part of the fixing unit 90 (the details of which shall be described below).

Forward-reverse switching mechanism 50 constitutes a paper ejection roller reversal mechanism that both reverses the transport direction of the recording medium that is ejected from the image-formation part 10 and further transports the recording medium that has had its transport direction reversed to the side of the image-formation part 10, and the two-sided printing unit 60 constitutes the transport pathway of the recording medium that has had its transport direction reversed with the forward-reverse switching mechanism 50. Next, these devices 10, 20, 30, 40, 50, 60, etc., are housed inside of the chassis 3 is a state where they are set in a frame that is a framework.

2.1. Feeder Part

The feeder part 20 is configured to have a feed tray 21 in the lowest part of case 3, a feed roller 22 that is provided at the top of the front end of the feed tray 21 and that transports the recording medium to the image-formation part 10, and a separation roller 23 and separation pad 24, etc., that separate the recording medium that is transported by the feed roller 22 one sheet at a time. Next, the recording medium that is held at the feed tray 21 is made to perform a U-turn at the inner front side of the chassis 3, and is transported to the image-formation part 10 that is established at approximately the center of the interior of the chassis 3.

Furthermore, within the transport pathway of the recording medium from the feed tray 21 to the image-formation part 10, a paper debris removal roller 25 for removing paper debris, etc., that has become attached to the image-formation surface (the printing surface) of the recording medium is established on the exterior of the top of the area that performs the U-turn, and opposing roller 26 that presses the recording medium that is transported against the paper debris removal roller 25 is established at the interior of the top.

In addition, resist rollers 27 may include a pair of rollers that transmit transport resistance to the recording medium and order the transport state of the recording medium are established at the entrance to the image-formation part 10 within the transport pathway from the feed tray 21 to the image-formation part 10.

2.2. Image-Formation Part

Image-formation part 10 is configured to have scanner part 70, process cartridge 80, fixing unit 90, etc.

2.2.1. Scanner Part

Scanner part 70 forms an electrostatic latent image on the surface of the photoconductor drum 81 that is established at the top inside of the chassis 3 and will be described below, and specifically, the scanner part may include a laser light source a polygon mirror, an fθ lens, a reflecting mirror, etc.

Next, a laser beam based on the image data emitted from the laser light source is deflected by the polygon mirror, and after passing through the fθ lens, and after the light path has been turned back by a reflecting mirror, the light path is further deviated downward by a reflecting mirror, whereby it irradiates the surface of the photoconductor drum 81, and an electrostatic latent image is formed.

2.2.2. Process Cartridge

The process cartridge 80 is provided so that it can be attached to and detached inside of the chassis 3 on the lower side of the scanner part 70, and this process cartridge 80 may include a photoconductor drum 81, a charger 82, a transfer roller 83, a processing cartridge 84, etc.

Next, the photoconductor drum 81 constitutes an image-support system that supports the image transferred onto the recording medium, and it may include a cylindrical drum unit 81*a* that includes a positively charged photosensitive layer where the most superficial layer may include a polycarbonate layer (or the like), etc., and a drum axis 81*b* that supports the drum unit 81*a* rotatably and extends following the longitudinal direction of the drum unit 81*a* at the axle center of this drum unit 81*a*.

The charger 82 may include a charging system that charges the surface of the photoconductor drum 81. The charger 82 may face the photoconductor drum 81 above and diagonally behind the photoconductor drum 81 at a specified distance so that it does not touch the photoconductor drum 81. Furthermore, the charger 82 corresponding to the present illustrative embodiment employs a positively charged Scorotron type charger that uses a corona discharge to charge the surface of the photoconductor drum 81 approximately uniformly.

The transfer roller 83 is provided facing the photoconductor drum 81 and rotates in conjunction with the photoconductor drum 81, and when the recording medium passes through the vicinity of the photoconductor drum 81, and it constitutes a transfer systems that transfers the toner that is adhered to the surface of the photoconductor drum 81 to the printing surface of the recording medium by applying the charge (a negative charge in the present illustrative embodiment) that is the opposite of the charge that has charged the photoconductor drum 81 to the recording medium from the side opposite the printing surface.

Processing cartridge 84 is configured to have a toner housing 84*a* in which toner is housed, a toner feed roller 84*b* that feeds toner to the photoconductor drum 81, a processing roller 84*c*, etc.

Next, the toner housed in the toner housing 84*a* is fed to the side of the processing roller 84*c* by way of the rotation of the toner feed roller 84*b*, and furthermore, the toner fed to the side of the processing roller 84*c* is supported on the surface of the processing roller 84*c*, and after the thickness of the supported toner is adjusted to become constant (even) at a prescribed thickness by way of a thickness regulating blade 84*d*, the toner is also fed to the surface of the photoconductor drum 81 that is exposed by the scanner part 70.

2.2.3. Fixing Unit

The fixing unit 90 is provided downstream from the photoconductor drum 81 in the transport direction of the recording medium, and it heats and melts the toner that has been transferred to the recording medium in order to affix it. Specifically, the fixing unit 90 is configured to have a heating roller 91 that transfer the transporting force to the recording medium while heating the toner that is provided on the printing surface of the recording medium, and a pressure roller 92 that sandwiches the recording medium and is provided on the opposite side of the heating roller 91 and that presses the recording medium against the side of the heating roller 91, etc.

Furthermore, in the present illustrative embodiment, the transport device corresponding to the present illustrative embodiment is applied to the heating roller 91 and the gear mechanism that rotates the heating roller 91, the details of which are described below.

Next, in the image-formation part 10 that was described above, an image is formed on the recording medium as described below.

In other words, after the surface of the photoconductor drum 81 is uniformly positively charged by way of the charger 82 with its rotation, it is exposed by high-speed scanning by the laser beam emitted from the scanner part 70. By this approach, an electrostatic latent image is formed on the surface of the photoconductor drum 81 that corresponds to the image that is to be formed on the recording medium.

Next, by the rotation of the processing roller 84*c*, the toner that is supported on the processing roller 84*c* and that is positively charged is fed to the electrostatic latent image that is formed on the surface of the photoconductor drum 81 when it touches the opposing photoconductor drum 81, that is to say, the exposed part of the surface of the uniformly positively-charged photoconductor drum 81 that is exposed by the laser beam and where the electric potential has decreased. By this approach, the electrostatic latent image of the photoconductor drum 81 is made into a visible image, and the toner image is supported on the surface of the photoconductor drum 81 by reversal development.

Thereafter, the toner image supported on the surface of the photoconductor drum 81 is transferred to the recording medium by the transfer bias applied to the transfer roller 83.

Next, the recording medium to which the toner image has been transferred is transported to the fixing unit 90 and heated, and the toner transferred as the toner image is affixed to the recording medium, and image-formation is completed.

2.3. First Ejection Chute and Second Ejection Chute

The first ejection shoot 30 is provided downstream from the fixing unit 90 in the transport direction of the recording medium, and it is also a guide system that rotates the transport direction of the recording medium—for which the image-formation has been completed at the image-formation part 10—by approximately 90° and guides the recording medium to the second ejection shoot 40.

In addition, the second ejection shoot 40 is established at the upper cover 9 that has a prescribed gap 40*a* in relation to the first ejection shoot 30, and it is a guide system that further rotates the recording medium—for which the transport direction at the first ejection shoot 30 was rotated by approximately 90°—by approximately 90° and guides it to the ejection part 7.

Next, the gap 40*a* between the first ejection shoot 30 and the second ejection shoot 40 constitutes a part of the transport pathway (the transport pathway indicated by the thick two-dot chain line) of the recording medium where the transport direction has been reversed at the forward-reverse switching mechanism 50. Incidentally, in FIG. 2 the transport pathway indicated by the thick one-dot chain line indicates the transport pathway of the recording medium transported by feeder part 20.

2.4. Configuration of the Transport Device

Figure 3:
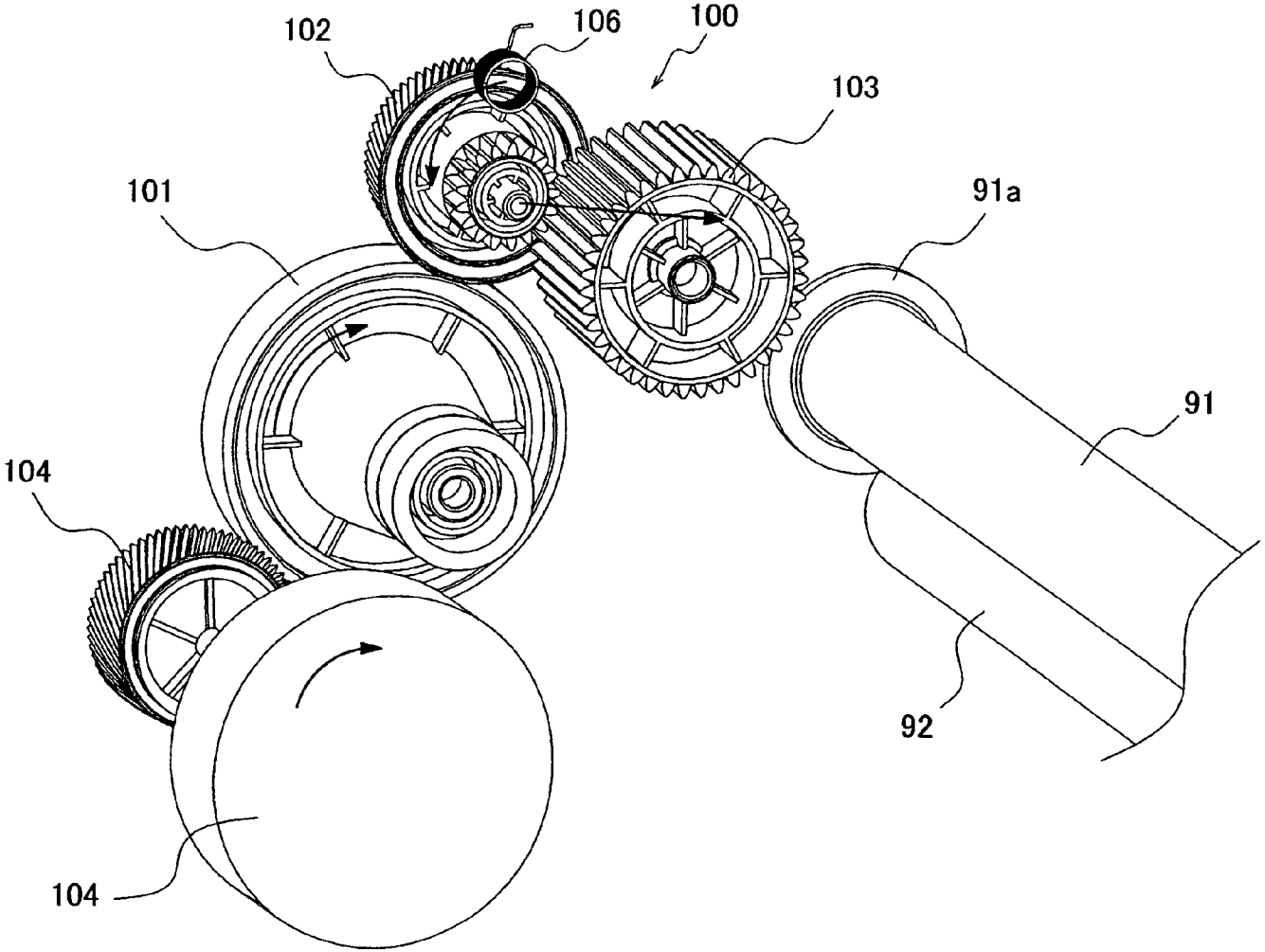
FIG. 3 shows a structure of a gear mechanism that transmits a driving force (or turning force) to a heating roller corresponding to illustrative embodiments of the present invention.
Figure 4:
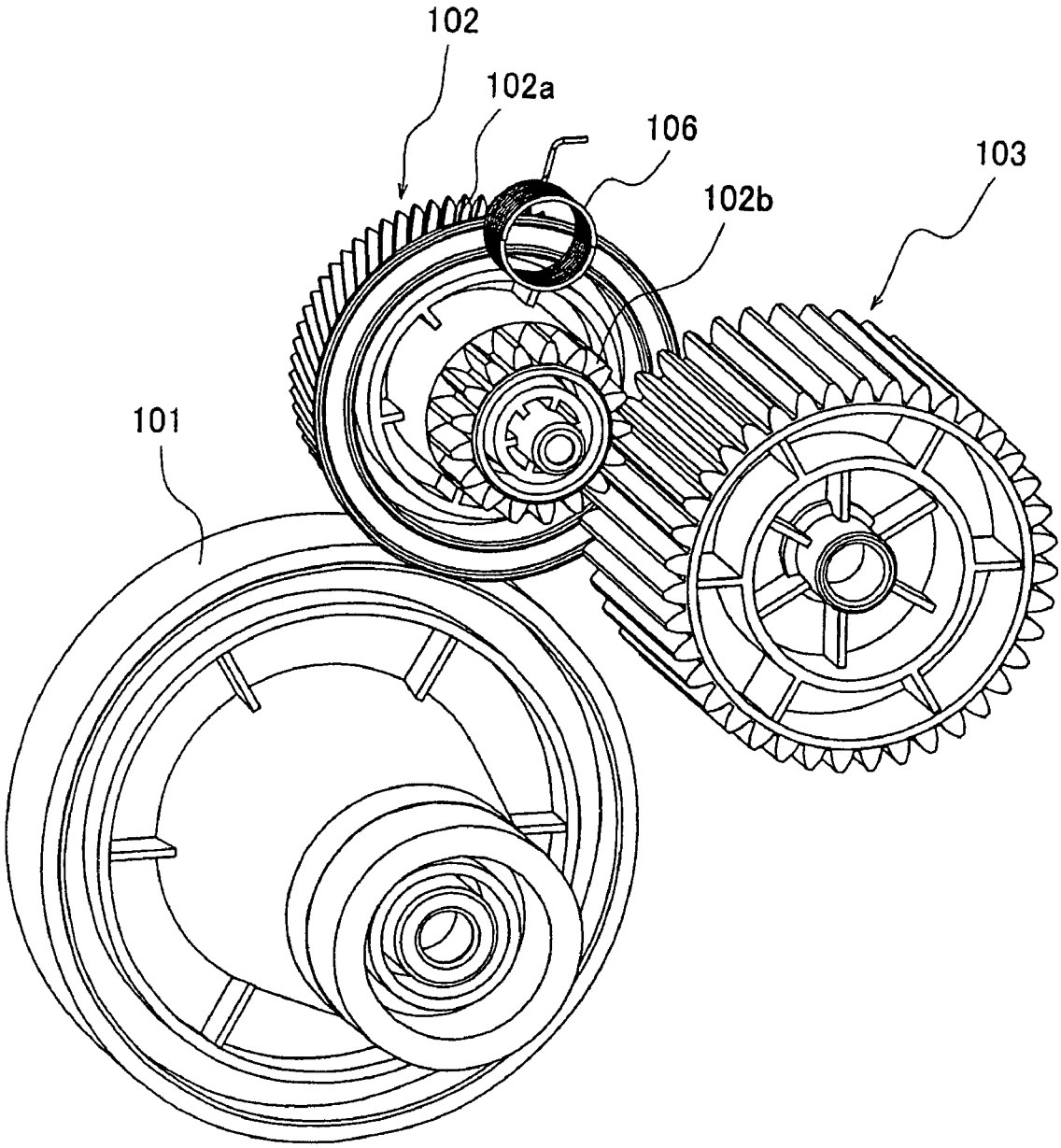
FIG. 4 shows a perspective view of an arrangement of gears in accordance with illustrative embodiments of the present invention.
Figure 5:
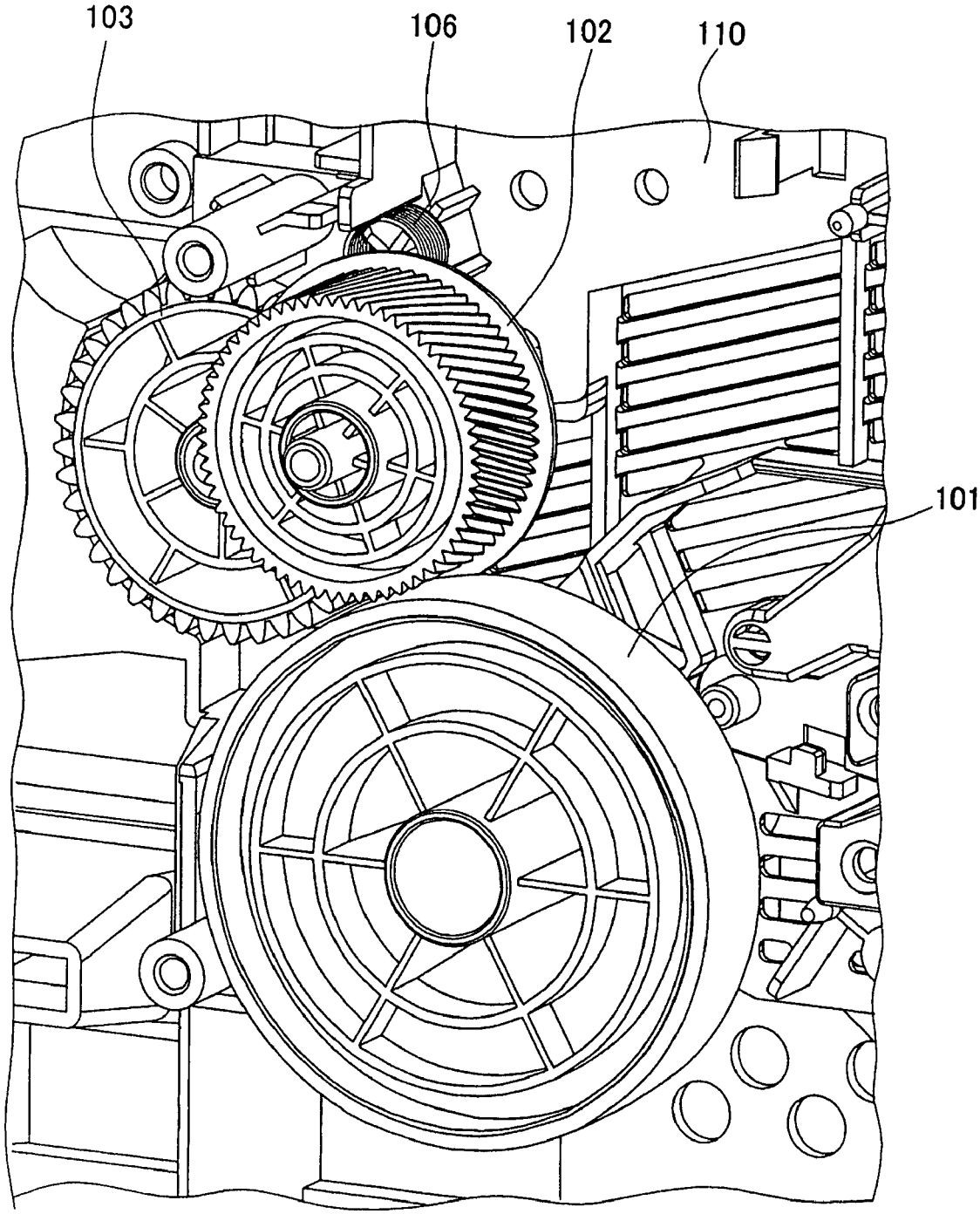
FIG. 5 shows a perspective view of the back side of the arrangement of FIG. 4.
Figure 6:
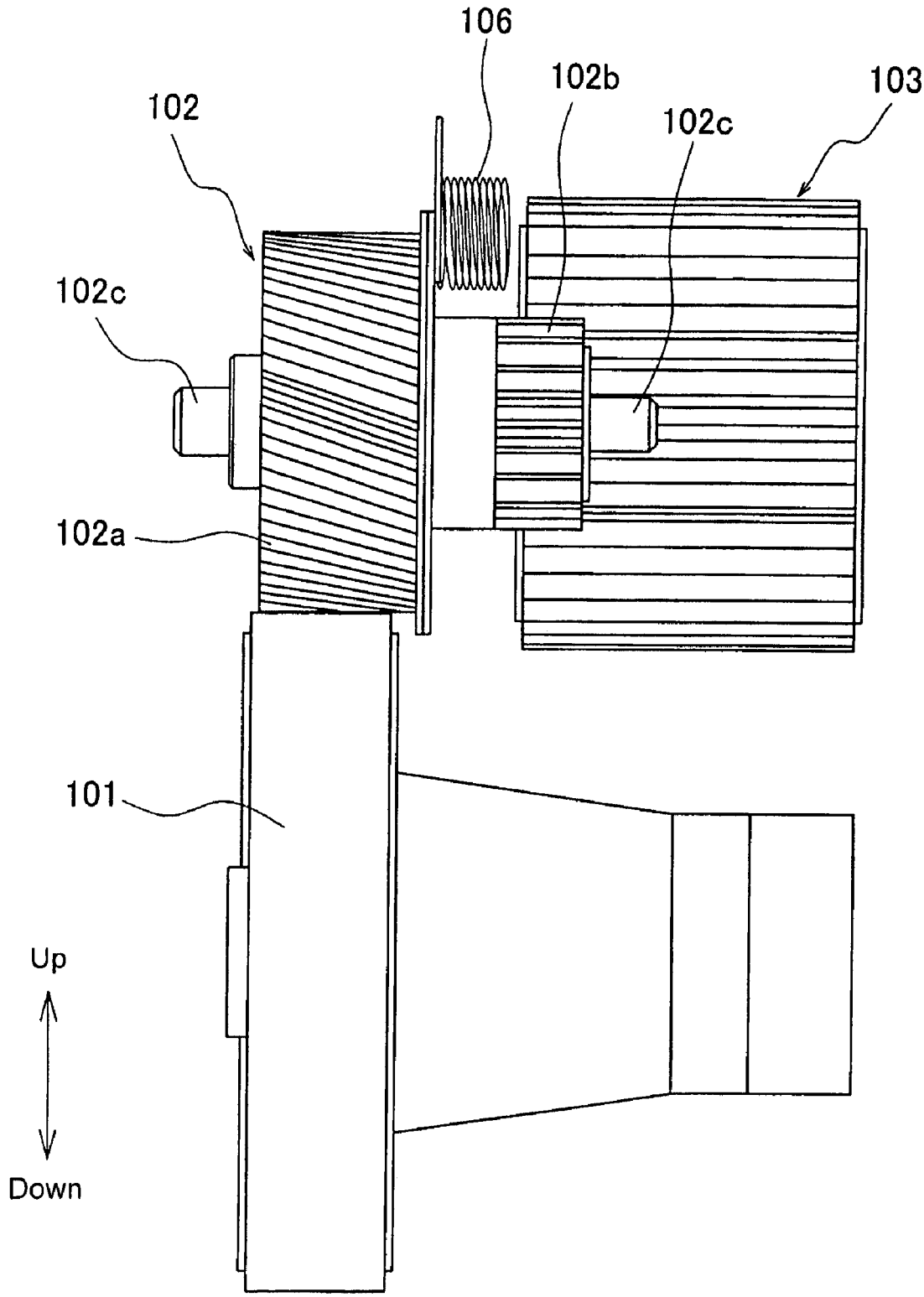
FIG. 6 shows a top view of the arrangement of FIG. 4.
Figure 7:
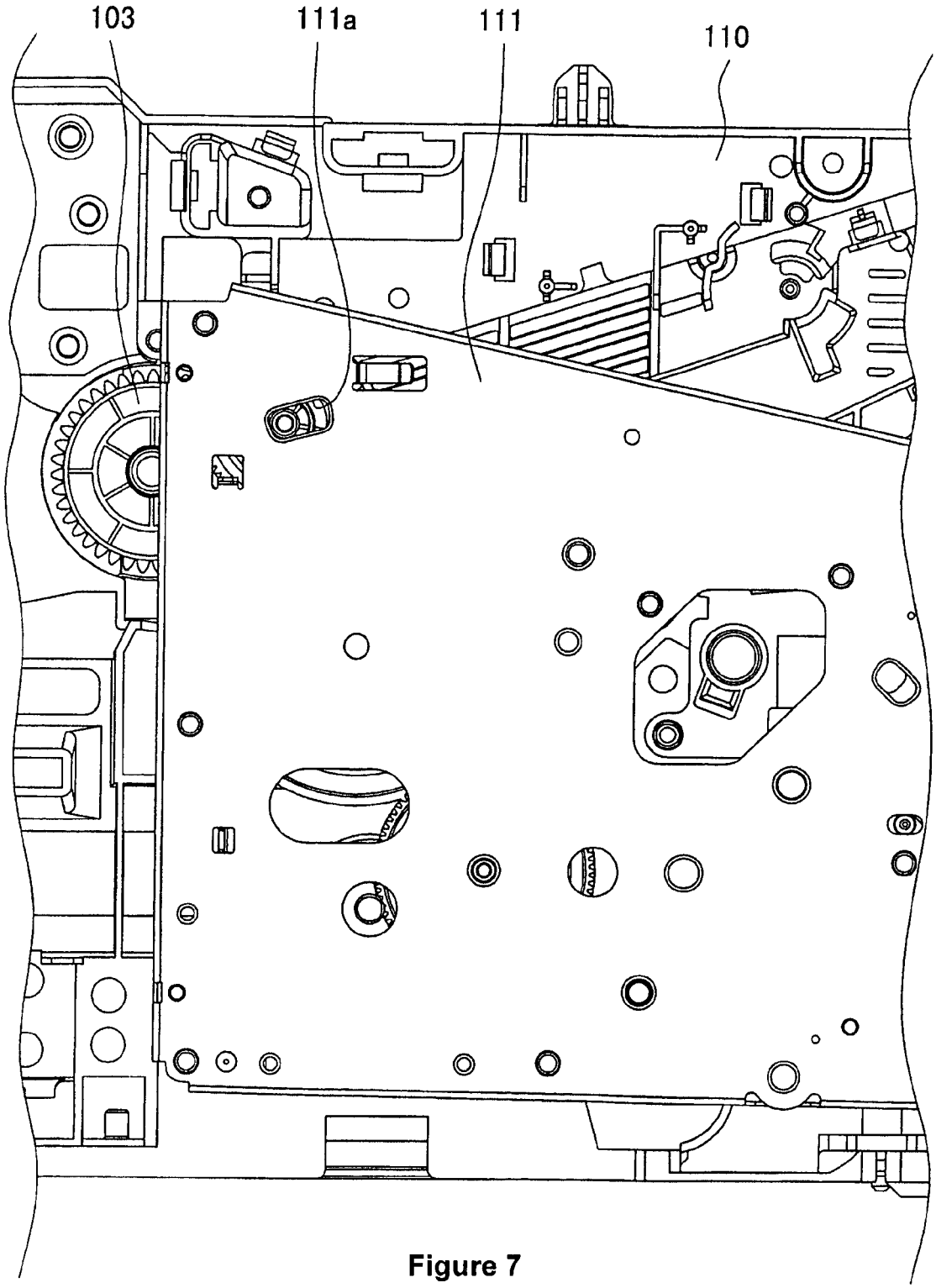
FIG. 7 shows the gear mechanism in a unit frame corresponding to illustrative embodiments of the present invention.
Figure 8:
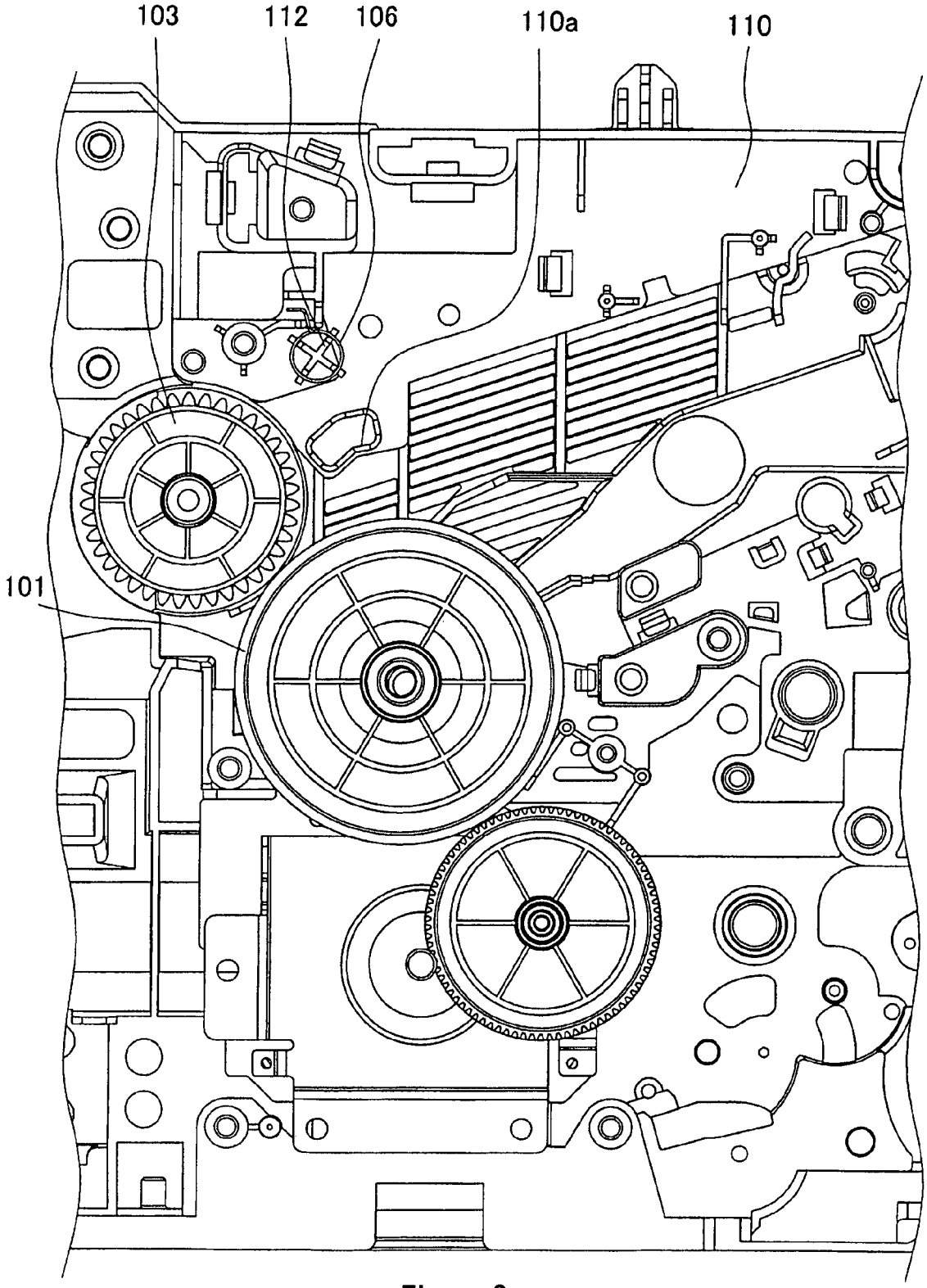
FIG. 8 shows a front view of the unit frame corresponding to illustrative embodiments of the present invention.
Figure 9:
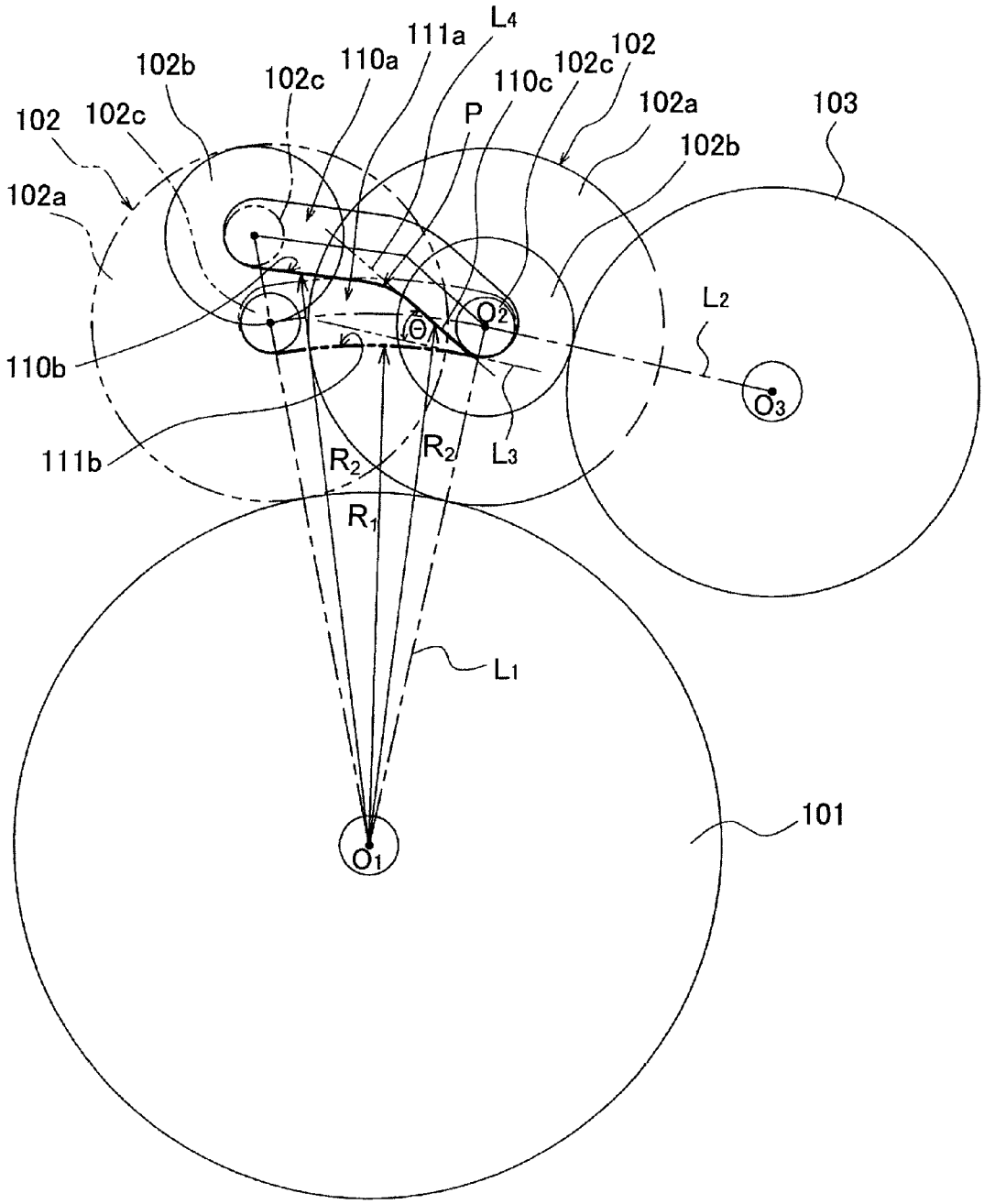
FIG. 9 shows an illustration of a first groove and a second groove corresponding to illustrative embodiments of the present invention.

FIG. 3 is a figure showing the structure of the gear mechanism 100 that transmits the driving force (turning force) to the heating roller 91, FIG. 4 is a perspective view showing the arrangement of the gears that compose the primary part of the gear mechanism 100, FIG. 5 is a perspective view of the back side of FIG. 4, FIG. 6 is a top view of FIG. 4, FIG. 7 is a figure showing the state where the gear mechanism 100 has been set in the unit frame 110, FIG. 8 is a front view of the unit from 110, and FIG. 9 is an explanatory drawing of the first groove 111*a* and the second groove 110*a*.

The gear mechanism 100, as shown in FIG. 3—in addition to having a driving gear 101, an intermediate gear 102, and a driven gear 103—is configured to have a transmission gear 105, etc., that decelerates the driving force generated by the electric motor 104 that constitutes the drive source and transmits it to the driving gear 101, and the driven gear 103 is engaged with a gear part 91*a* that is provided at the end of heating roller 91 in the direction of the axis.

For this reason, the driving force generated by the electric motor 104 is transmitted sequentially by the heating roller 91 from the transmission gear 105 to the driving gear 101 to the intermediate gear 102 to the driven gear 103.

Next, the driving gear 101, the driven gear 103, and the transmission gear 105 are set in the unit frame 110 and the cover frame 111 that is rotatably attached and affixed to the unit frame 110 (refer to FIG. 7), and the position of its center of rotation is fixed in relation to the unit frame 110 and the cover frame 111. Incidentally, in the present illustrative embodiment the unit frame 110 is made of an ABS resin, etc., and the cover frame 111 is made of a metal such as rolled steel plate.

Meanwhile, the intermediate gear 102, as shown in FIG. 6, has a first gear part 102*a* that engages with the intermediate gear 101 and a second gear part 102*b* that is established on the same axis as the first gear part 102*a* and integrally rotates with the first gear part 102*a*, and the rotation axis 102*c* is attached to the unit frame 110 and the cover frame 111 so that it can be displaced around the center of rotation of the driving gear 101.

Specifically, a first groove 111*a* is established in the cover frame 111 as a slotted hole (refer to FIG. 7), and while a second groove 110*a* (refer to FIG. 8) in the approximate shape of a dogleg is established on the unit frame 110, the side of the first gear part 102*a* within the rotation axis 102*c* is slidably and rotatably inserted into the first groove 111*a*, and the second gear part 102*b* within the rotation axis 102*c* is slidably and rotatably inserted into the second groove 110*a*, whereby the rotation axis 102*c* is supported in the first groove 111*a* and the second groove 110*a*.

Also, as shown in FIG. 9, the surface that receives the load that acts on the rotation axis 102*c* within the first groove 111*a*—that is to say, the surface 111*b* that touches the rotation axis 102*c* within the first groove 111*a* (hereinafter this surface shall be called the first receiving surface 111*b*), is extended and formed into an approximately arc-shaped curve so that it approximately follows the direction of rotation (the circumferential direction) of the driving gear 101 so that the distance R1 with the center of rotation O1 of the driving gear 101 remains approximately constant.

Meanwhile, the surface that receives the load that acts on the rotation axis 102*c* within the second groove 110*a*—that is to say, the surface 110*b* that touches the rotation axis 102*c* within the second groove 110*a* (hereinafter this surface shall be called the second receiving surface 110*b*) is provided with and inclined receiving part 110*c* that extends in the direction of rotation of the driving gear 101 so that the distance R2 (hereinafter this distance R2 shall be called the radius of the receiving surface R2) from the center of rotation O1 of the driving gear 101 increases as it moves away from the driven gear 103 (as it moves toward the left side of the paper surface).

Furthermore, "the inclined receiving part 110*c* is extended in the direction of rotation of said driving gear 101" does not signify that the longitudinal direction of the inclined receiving part 110*c* is definitely the same as the direction of rotation the circumferential direction of the driving gear 101, but rather is significant to the extent that the longitudinal direction of the inclined receiving part 110*c* extends in the direction that intersects with the radial direction of the driving gear 101.

In addition, in the present illustrative embodiment, the second receiving surface 110*b* is curved so that the rate of increase of the radius R2 of the receiving surface at the side of the driven gear 103 (the right side of the paper surface) within the inclined receiving part 110*c* is greater than the rate of increase of the radius R2 of the receiving surface at the side opposite the driven gear 103 (the left side of the paper surface) within the inclined receiving part 110*c*.

Specifically, in the interval from the right side of the paper surface within the inclined receiving part 110*c* to point P (the folding point), the radius R2 of the receiving surface is linearly expanded, and in the interval from point P to the left side of the paper surface within the inclined receiving part 110*c*, the radius R2 of the receiving surface is linearly expanded at a smaller rate of increase than before it. For this reason, the inclined receiving part 110*c* corresponding to the present illustrative embodiment has the curved shape of an approximate dogleg so that the center of curvature is located on the side of the center of rotation O1 of the driving gear 101.

In addition, in the present illustrative embodiment, the part of the side of the driven gear 103 within the inclined receiving part 110*c* that is curved in the shape of an approximate dogleg (the right side of the paper surface) is inclined at an angle that is greater than or equal to the pressure angle of the intermediate gear 102 in relation to a reference line L3 that is parallel with a center line L2 that connects the center of rotation O2 in a state where said intermediate gear 102 is engaged with said driven gear 103 and the center of rotation O3 of said driven gear 103.

That is to say, in the present illustrative embodiment, the inclined receiving part 110*c* is established so that the angle Θ that may include the inclined reference line L4 that is parallel to the part of the side of the driven gear 103 within the inclined receiving part 110*c* (the right side of the paper surface) and the reference line L3 that is parallel with the center line L2 is greater than or equal to the pressure angle (which is 20° in the present illustrative embodiment).

Incidentally, in the present illustrative embodiment, the pressure angle is 20°, and the part of the side of the driven gear 103 within the inclined receiving part 110*c* (the right side of the paper surface) is linear, so the angle Θ that may include the inclined reference line L4 that is parallel to the part of the side of the driven gear 103 within the inclined receiving part 110*c* (the right side of the paper surface) and the reference line L3 that is parallel with the center line L2 is made to be 20° at the design center.

In addition, as shown in FIG. 4, a coil spring 106 is provided on the side opposite the driving gear 101 and sandwiching the center of rotation of the intermediate gear 102 that presses (applies force to) the intermediate gear 102 from the side of the second gear part 102*b* toward the side of the first gear part 102*a*, and this coil spring 106 presses (applies force to) the vicinity of the maximum outside diameter within the intermediate gear 102, that is to say the vicinity of the outside diameter of the first gear part 102*a*.

For example, in the present illustrative embodiment, the coil spring 106, as shown in FIG. 8, is fixed by insertion into the protrusion 112 that is established on the unit frame 110.

3. Operation of the Transport Device and Characteristics of the Present Illustrative Embodiment FIG. 10 is a figure showing the state of the force that acts on the intermediate gear 102 when the driving force is transmitted to the driven gear 103 (when the driving gear 101 is normally rotated), and FIG. 11 is a figure showing the state of the force acting on the intermediate gear 102 when the driving gear 101 is rotated in reverse.

3.1. When the Driving Force is being Transmitted to the Driven Gear 103 (refer to FIG. 10)

When the driving force is transmitted to the driven gear 103 (when the driving gear 101 is rotated normally), then the driving gear 101 is rotated so that the direction of the force F1 that acts on the intermediate gear 102 at the engagement part of the intermediate gear 102 and the driving gear 101 is a direction that approaches the driven gear 103.

Figure 10:
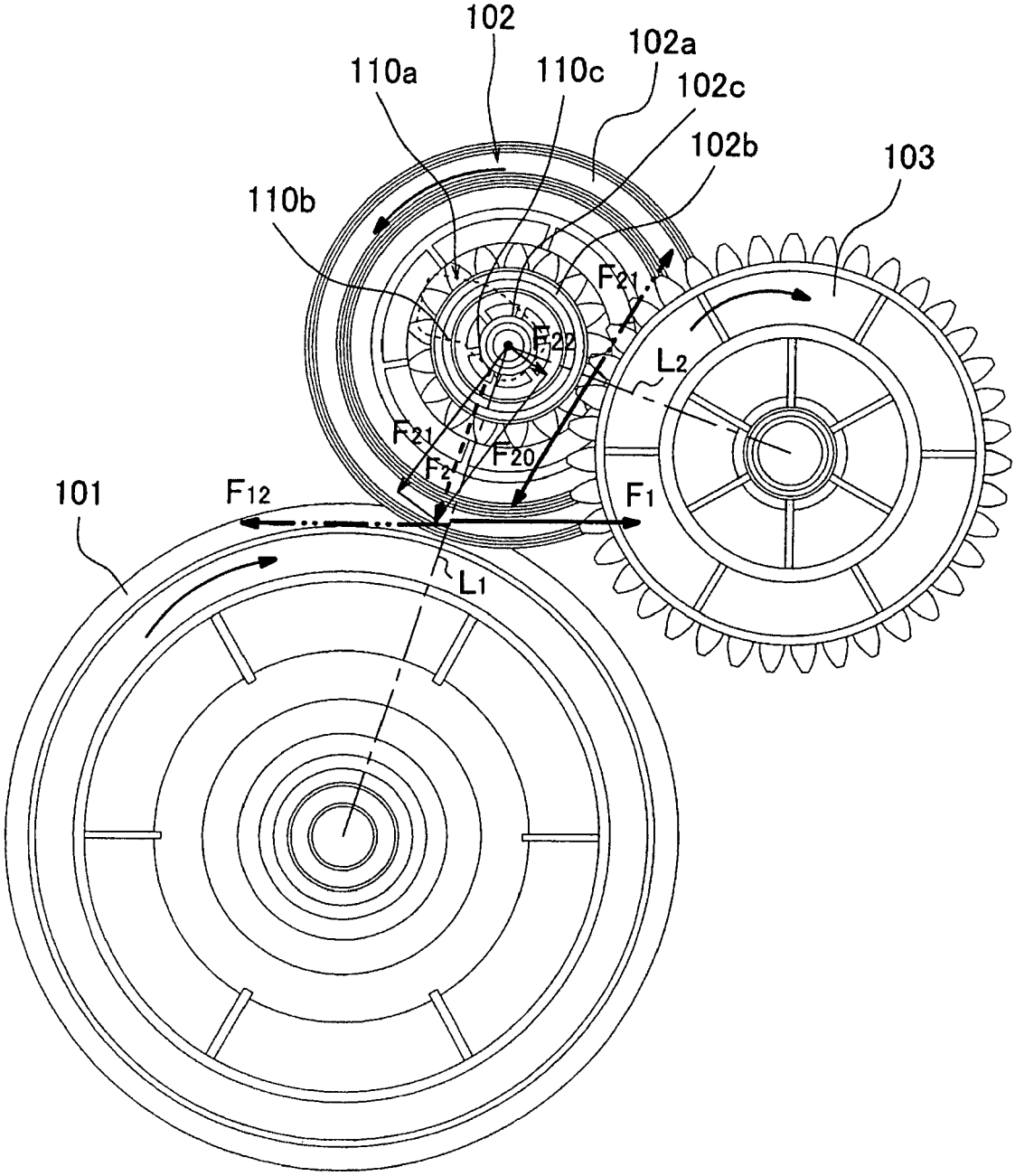
FIG. 10 shows the state of the force acting on an intermediate gear when the driving force is being transmitted to the driven gear corresponding to illustrative embodiments of the present invention.
Figure 11:
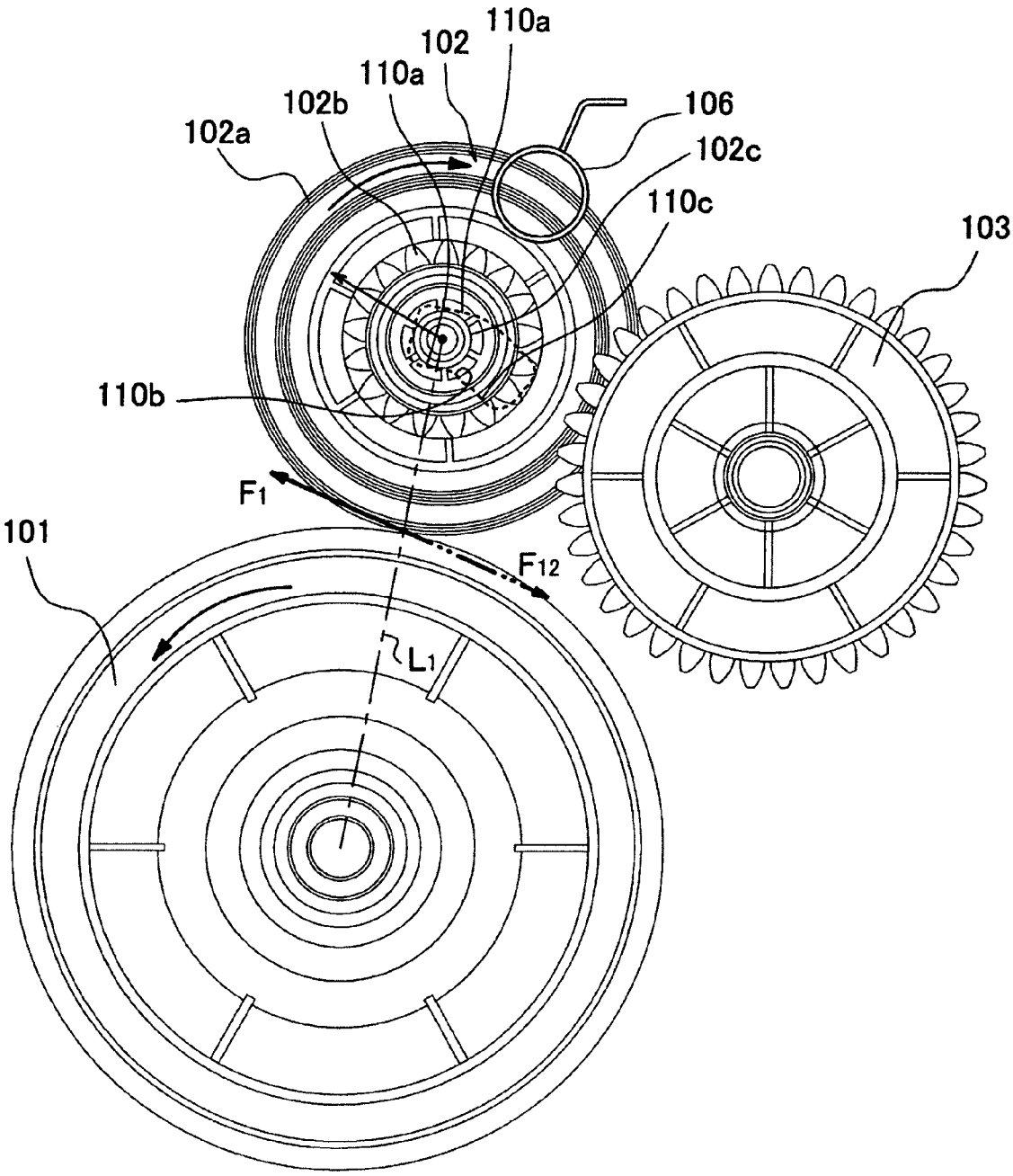
FIG. 11 shows a state of the force acting on the intermediate gear when the driving gear is rotated in reverse corresponding to illustrative embodiments of the present invention.
Figure 12:
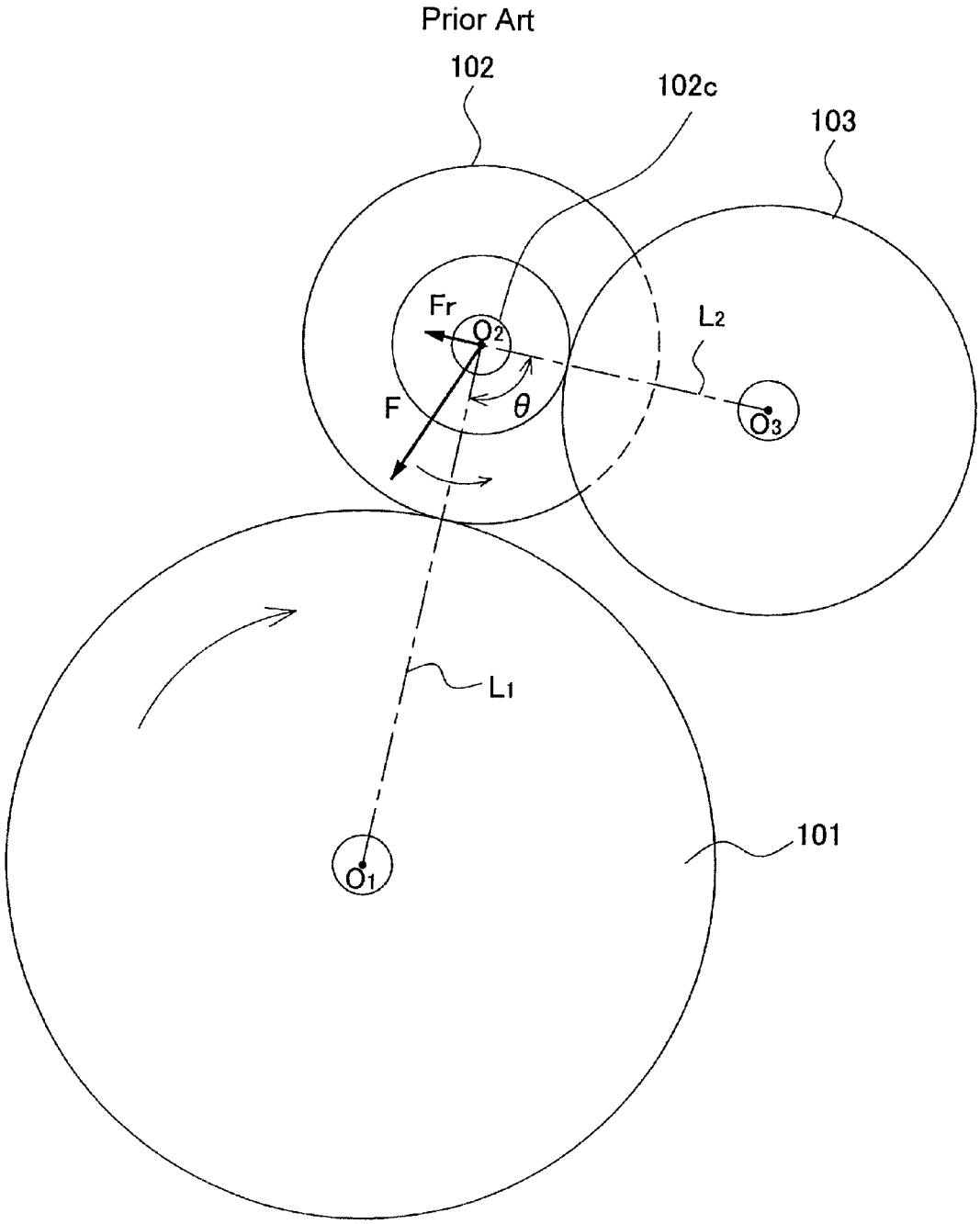
FIG. 12 shows a conventional system.

Furthermore, in FIG. 10, in order for the driving gear 101 to rotate in a clockwise rotation, the force F1 is a force in a direction inclined the full amount of the pressure angle in relation to the tangent line at the pitch point of the engagement of the intermediate gear 102 and the driving gear 101 and toward the right of the paper surface, and the driving gear

101 receives the force F12 from the intermediate gear 102 as the counteraction of the force F1.

Meanwhile, the driven gear 103 is driven via the intermediate gear 102, so it rotates in the same direction as the driving gear 101. At this time, because the arrangement angle that is the angle composed of the center line L1 and the center line L2 is less than 180°, the force F20 that acts on the intermediate gear 102 at the engagement part of the driven gear 103 and the intermediate gear 102 is a force that includes the directional component pressing the intermediate gear 102 against the driving gear 101.

In other words, the intermediate gear 102 receives the downward force on the paper surface that is in a direction inclined the full amount of the pressure angle in relation to the tangent line at the pitch point of the engagement of the intermediate gear 102 and the driven gear 103 as the counteraction of the force F20, and meanwhile, the driven gear 103 receives the force F21 as the counteraction of the force F20.

Next, the force F20 that acts on the intermediate gear 102 is received by the rotation axis 102*c*, so the force F2 acts on the rotation axis 102*c*. At this time, in the present illustrative embodiment, the arrangement angle is 90° (less than 110°), so the force F2 that includes the component of the force F2 in the direction inclined the full amount of the pressure angle in relation to the center line L1 and that faces in the direction of the driving gear 101 (downward on the paper surface)—that is to say the component that presses on the intermediate gear 102 to the side of the driving gear 101—and the component in the direction that releases the intermediate gear 102 from the driven gear 103 is received by the rotation axis 102*c*.

Incidentally, as described above, if the arrangement angle is greater than or equal to 110°, then the force that includes the component in the direction that releases the intermediate gear 102 from the driven gear 103 does not act on the rotation axis 102*c*.

Incidentally, the force F2 that acts on the rotation axis 102*c* is a force that is generated by way of its engagement with the driven gear 103, so most of the force F2 is received by the second groove 110*a* that is the part supporting the side of the second gear part 102*b* (the inclined receiving part 110*c*) that engages with the driven gear 103.

Meanwhile, in the present illustrative embodiment the inclined receiving part 110*c* is structured so that the radius of the receiving surface R2 increases as it moves away from the driven gear 103, so the inclined receiving part 110*c* becomes an inclined surface that is inclined in the direction to release the intermediate gear 102 from the driven gear 103, that is to say, in the direction of the tangent at the circle (hereinafter this circle shall be referred to as the inclined receiving part circle) that passes through the contact point of the inclined receiving part 110*c* and the rotation axis 102*c* as the center of the center of rotation of the driving gear 101.

Furthermore, in the present illustrative embodiment, the arrangement angle is 90°, so the angle that may include the direction of the tangent at the inclined receiving part circle and the inclined receiving part 110*c* becomes equivalent to the angle Θ) that may include the inclined reference line L4 and the reference line L3. Thus, below, the angle that may include the direction of the tangent at the inclined receiving part circle and the inclined receiving part 110*c* is marked as the incline angle Θ of the inclined receiving part 110*c*.

For this reason, the inclined receiving part 110*c* makes the force in the opposite direction of the direction to release the intermediate gear 102 from the driven gear 103—that is to say, the force F22 including the component in the direction making the intermediate gear 102 approach the driven gear 103—act upon the rotation axis 102*c* as the counteraction of the force F2 that acts on the rotation axis 102*c*, so the intermediate gear 102 does not separate from the driven gear 103.

Consequently, with the present illustrative embodiment, the arrangement angle does not increase, and it is possible to prevent the engagement of the intermediate gear 102 and the driven gear 103 from releasing due to the reaction force F2 from the driven gear 103.

Furthermore, within the force F2 that acts on the rotation axis 102*c*, the component F21 that is perpendicular to the inclined receiving surface 110*c* is received at the inclined receiving part 110*c*, and the component F22 that is parallel with the inclined receiving part 110*c* is received by the end wall of the second groove 110*a*.

3.2. When the Driving Gear 101 is Rotated in Reverse (refer to FIG. 11)

When releasing the driven gear 103 and the intermediate gear 102 from the engaged state, the driving gear 101 is rotated in reverse. By this arrangement, the direction of the force F1 that acts on the intermediate gear 102 at the engagement part of the intermediate gear 102 and the driving gear 101 becomes the direction of moving away from the driven gear 103, and this force F1 that acts on the intermediate gear 102 acts on the rotation axis 102*c*, so the intermediate gear 102 moves away from the driven gear 103.

At this time, the first receiving surface 111*b* of the first groove 111*a* is made into an approximately arc-shaped curve so that it approximately follows the direction of rotation (the circumferential direction) of the driving gear 101 so that the distance R1 with the center of rotation O1 of the driving gear 101 remains approximately constant, so even if the intermediate gear 102 is displaced such that it separates from the driven gear 103, the state of engagement of the first gear part 102*a* and the driving gear 101 is maintained.

Meanwhile, because an inclined receiving part 110*c* where the radius R2 of the receiving surface increases as it separates from the driven gear 103 is established at the second groove 110*a*, the engagement state of the second gear part 102*b* (the intermediate gear 102) and the driven gear 103 is released, and when the intermediate gear 102 is released from the driven gear 103, the side of the second gear part 102*b* within the rotation axis 102*c* separates from the driven gear 103 while separating from the center of rotation of the rotation axis 101.

In other words, with the present illustrative embodiment, whereas the side of the first gear part 102*a* of the rotation axis 102*c* separates from the driven gear 103 while maintaining the distance R1 with the driving gear 101 when the driving gear 101 is rotated in reverse, the side of the second gear 102*b* within the rotation axis 102*c* separates from the driven gear 103 while separating from the center of rotation of the driving gear 101, so in the state where the engagement of the intermediate gear 102 and the driven gear 103 is released, the rotation axis 102*c* of the intermediate gear 102 enters a "skewed position" in relation to the driving gear 101 and the rotation axis of the driven gear 103.

As explained above, according to the present illustrative embodiment, it is possible to continue to prevent the engagement of the intermediate gear 102 and the driven gear 103 from releasing due to the reaction force F2 from the driven gear 103 without increasing the arrangement angle, and to reliably release only the engagement of the second gear part 102*b* and the driven gear 103 while maintaining the engaged state of the first gear part 102*a* and the driving gear 101.

Incidentally, as the incline angle Θ of the inclined receiving part 110*c* increases—that is to say, as the rate of increase of the radius R2 of the receiving surface increases—it is possible to reliably prevent the engagement of the driven gear 103 and the intermediate gear 102 from becoming released when the driving force is transmitted to the driven gear 103.

However, as the incline angle Θ of the inclined receiving part 110*c* increases, within the force F1 that acts on the rotation axis 102*c*, the component in the direction parallel to the inclined receiving part 110*c* becomes smaller, so even if the driving gear 101 is rotated in reverse, the side of the second gear part 102*b* within the rotation axis 102*c* becomes difficult to displace.

Correspondingly, in the present illustrative embodiment, the rate of increase of the radius R2 of the receiving surface at the side of the driven gear 103 (the right side of the paper surface) within the inclined receiving part 110*c* is greater than the rate of increase of the radius R2 of the receiving surface at the side opposite the driven gear 103 (the left side of the paper surface) within the inclined receiving part 110*c*, so it is possible to reliably prevent the engagement of the driven gear 103 and the intermediate gear 102 from releasing when the driving gear 101 is rotated normally, and on the other hand, when the driving gear 101 is rotated in reverse, the side of the second gear 102*b* within the rotation axis 102*c* is displaced and the engagement of the driven gear 103 and the intermediate gear 102 is released, and the rate of increase of the radius R2 of the receiving surface is decreased, and the incline angle Θ of the inclined receiving part 110*c* is decreased, so it is possible to easily displace the side of the second gear part 102*b* within the rotation axis 102*c*.

Consequently, it is possible to reliably prevent the engagement of the driven gear 103 and the intermediate gear 102 from releasing when the driving gear 101 is rotated normally, and on the other hand, when the driving gear 101 is rotated in reverse, it is possible to easily release the engagement of the driven gear 103 and the intermediate gear 102.

Furthermore, as is made clear from the explanation above as well, the part of the radius of the receiving surface R2 where the rate of increase is large, that is to say, the size (length) of the part on the side of the driven gear 103 within the inclined receiving part 110*c*, is to be determined as appropriate according to the diameter of the rotation axis 102*c*, the tooth depth of the second gear part 102*b*, and so on, so it is desirable to structure it such that the rate of increase of the radius of the receiving surface R2 is decreased when the engagement of the second gear part 102*b* and the intermediate gear 103 has been released.

Incidentally, as stated previously, when the engagement of the driven gear 103 and the intermediate gear 102 is released, the rotation axis 102*c* of the intermediate gear 102 is displaced so that it enters a "skewed position" in relation to the rotation axis of the driving gear 101 and the driven gear 103.

Consequently, as seen in the present illustrative embodiment, if the center of rotation of the intermediate gear 102 is sandwiched on the side opposite of the driving gear 101 and pressure (force) is applied to the intermediate gear 102 from the side of the second gear part 102*b* in the direction of the side of the first gear part 102*a*, it is possible to transfer the force displacing the rotation axis 102*c* so that it enters a "skewed position" to the intermediate gear 102, so when the driving gear 101 is rotated in reverse, it is possible to easily release the engagement of the driven gear 103 and the intermediate gear 102.

In addition, in the present illustrative embodiment, the vicinity of the maximum outside diameter within said intermediate gear 102 is being pressed, so it is possible to easily displace the rotation axis 102*c* so that it enters the "skewed position" with relatively little force, and so when the driving gear 101 is rotated normally and the driving force is being transmitted, it is possible to reduce the rotation resistance generated by the intermediate gear 102.

Incidentally, if the distance between the center of rotation O1 of the driving gear 101 and the center of rotation O3 of the driven gear 103 is reduced, then it becomes possible to make the gear mechanism 100 smaller, and when the distance between the center of rotation O1 of the driving gear 101 and the center of rotation O3 of the driven gear 103 is reduced, the arrangement angle becomes smaller, so as described in the "Problem to be solved by the invention" section, the engagement of the driven gear 103 and the intermediate gear 102 may become released.

Consequently, if the transport device corresponding to aspects of the present invention is used, the miniaturization of the laser printer can still be obtained, and it is possible to reliably prevent the engagement of the driven gear 103 and the intermediate gear 102 from becoming released.

4. The Correspondence of Specified Items of the Invention with the Illustrative Embodiments In the present illustrative embodiment, the heating roller 91 may generally be referred to as a roller, the coil spring 106 may be included in the pressure means as claimed herein, and at least one of the unit frame 110 and the cover frame 111 may be described as part of an overall frame of the system.

Other Illustrative Embodiments

In the illustrative embodiments described above, the inclined receiving part 110*c* was formed approximately across the entire area of the second receiving surface 110*b*, but aspects of the present invention are not limited to this; for example, it is also acceptable to form it only on the side of the driven gear 103 within the second receiving surface 110*b*, and then make it so that the radius of the receiving surface R2 is approximately constant thereafter.

In addition, in the illustrative embodiments described above, the inclined receiving part 110*c* was curved in the shape of an approximate dogleg, but aspects of the present invention are not limited to this; for example, it is also acceptable to have it be a smooth (continuous) curve throughout approximately across the entire area of the second receiving surface 110*b*.

In addition, in the illustrative embodiments described above, a helical gear was used as the first gear part 102*a*, but aspects of the present invention are not limited to this; for example, it is also acceptable to use a spur gear or a gear where crowning or relieving have been performed.

In addition, in the illustrative embodiments described above, as the first gear part 102*a*, the crown was inclined to engage sequentially starting with the side of the second gear part 102*b* at the time of driving power transmission, but aspects of the present invention are not limited to this, and conversely, it is also acceptable to use a "helical gear" where the crown inclines to engage sequentially starting with the side opposite the second gear part 102*b* at the time of driving power transmission.

In addition, in the illustrative embodiments described above, a spur gear was used as the second gear part 102*b*, but aspects of the present invention are not limited to this; for example, it is also acceptable to use a helical gear or a gear where crowning or relieving have been performed.

In addition, in the illustrative embodiments described above, a coil spring 106 was used as the pressure means, but the present invention is not limited to this; for example, it is also acceptable to use another elastic means such as a plate spring or rubber, etc., for example.

In addition, in the illustrative embodiments described above, pressure was applied near the maximum outside diameter within the intermediate gear 102 with the coil spring 106 that may be part of the pressure means, but aspects of the present invention are not limited to this.

In addition, in the illustrative embodiments described above, the present invention was explained using the heating roller 91 as an example of the roller, but aspects of the present invention are not limited to this, and it is acceptable to apply another roller.

In addition, in the illustrative embodiments described above, the first groove 111*a* was configured with a through-hole, and the second groove 110*a* was configured with a concave groove that has a bottom, but aspects of the present invention are not limited to this, and it is acceptable for both grooves 111*a* and 110*a* to be configured with a through-hole or with a concave groove that has a bottom, for example.

In addition, in the illustrative embodiments described above, the transport device corresponding to the present invention was applied to an image-formation device, but aspects of the present invention are not limited to this.

In addition, it is acceptable for aspects of the present invention to conform to the effect of the inventions described in the below claims, and it is not limited to the illustrative embodiments described above.

The invention claimed is:

1. A transport device comprising:

a driving gear rotatable about a fixed first axis;

an intermediate gear rotatable about a second axis, the second axis being arranged so that the second axis can be displaced around the first axis, the intermediate gear including a first gear part and a second gear part, the first gear part meshing with said driving gear, the second gear part integrally rotating with said first gear part;

a driven gear rotatable about a fixed third axis, the driven gear receiving a driving force from said intermediate gear by meshing with the second gear part;

a roller that receives the driving force transmitted via said driving gear, said intermediate gear and said driven gear, the roller rotating in order to transfer a medium, and a frame including a first groove and a second groove, the first groove supporting the second axis on a first side of said intermediate gear, the first side being where the first gear part is formed, the second groove supporting the second axis on a second side of said intermediate gear, the second side being where the second gear part is formed, wherein the first groove includes a first receiving surface that receives the load that acts on said second axis, the first receiving surface being extended so that said first receiving surface approximately follows the direction of rotation of said driving gear so that the distance between the first axis of said driving gear and the first receiving surface remains approximately constant; and the second groove includes a second receiving surface that receives the load that acts on said second axis, on the side of said driven gear with respect to said second receiving surface, the second receiving surface extending in the direction of rotation of said driving gear so that the farther the second receiving surface is away from said driven gear the distance between the first axis of said driving gear and the second receiving surface increases.

2. A transport device as described in claim 1, wherein a first radius of the second receiving surface is defined as the distance between said second receiving surface and the first axis of said driving gear, the rate of increase of said first radius on a side of said driven gear with respect to the second receiving surface becomes greater than the rate of increase of said first radius on a side opposite said driven gear with respect to the second receiving surface.

3. A transport device as described in claim 1, wherein a portion on the side of said driven gear with respect to the second receiving surface is inclined at an angle that is greater than or equal to a pressure angle of said intermediate gear in relation to a reference line that is parallel with a center line that connects the second axis in a state where said intermediate gear is engaged with said driven gear and the third axis of said driven gear.

4. A transport device as described in claim 1 further comprising a pressing element that presses said intermediate gear from the second side toward the first side, the pressing element being provided on the opposite side of said driving gear with respect to the second axis of said intermediate gear.

5. A transport device as described in claim 4 wherein said pressing element presses approximate maximum outside diameter of said intermediate gear.

6. An image-formation device comprising:

an image-formation part that forms an image on a recording medium; and a transport device wherein the transport device including:

a driving gear rotatable about a fixed first axis;

an intermediate gear rotatable about a second axis, the second axis being arranged so that the second axis can be displaced around the first axis, the intermediate gear including a first gear part and a second gear part, the first gear part meshing with said driving gear, the second gear part integrally rotating with said first gear part;

a driven gear rotatable about a fixed third axis, the driven gear receiving a driving force from said intermediate gear by meshing with the second gear part;

a roller that receives the driving force transmitted via said driving gear, said intermediate gear and said driven gear, the roller rotating in order to transfer the recording medium, and a frame including a first groove and a second groove, the first groove supporting the second axis on a first side of said intermediate gear, the first side being where the first gear part is formed, the second groove supporting the second axis on a second side of said intermediate gear, the second side being where the second gear part is formed, wherein the first groove includes a first receiving surface that receives the load that acts on said second axis, the first receiving surface being extended so that said first receiving surface approximately follows the direction of rotation of said driving gear so that the distance between the first axis of said driving gear and the first receiving surface remains approximately constant; and the second groove includes a second receiving surface that receives the load that acts on said second axis, on the side of said driven gear with respect to said second receiving surface, the second receiving surface extending in the direction of rotation of said driving gear so that the farther the second receiving surface is away from said driven gear the distance between the first axis of said driving gear and the second receiving surface increases.

* * * * *